US005149891A

United States Patent [19]

Morimoto et al.

[11] Patent Number: 5,149,891

[45] Date of Patent: Sep. 22, 1992

[54] METHOD FOR PREPARING PITCH FLUORIDE

[75] Inventors: Takeshi Morimoto, Yokohama; Mikio Sasabe, Tokyo; Toshiyuki Maeda; Hiroyuki Fujimoto, both of Osaka, Japan

[73] Assignee: Osaka Gas Company Limited, Osaka, Japan

[21] Appl. No.: 683,347

[22] Filed: Apr. 10, 1991

[30] Foreign Application Priority Data

Apr. 10, 1990 [JP] Japan ..... 2-93109
Jul. 20, 1990 [JP] Japan ..... 2-190800

[51] Int. Cl.[5] ..... C07C 17/02; C07C 17/04; C07C 17/02; C07C 23/46

[52] U.S. Cl. ..... 570/148; 570/130; 570/131

[58] Field of Search ..... 570/130, 131, 148

[56] References Cited

U.S. PATENT DOCUMENTS

| | | | |
|---|---|---|---|
| 3,480,667 | 11/1969 | Siegart et al. | 570/131 |
| 4,686,024 | 8/1987 | Scherer et al. | 570/130 |
| 4,931,163 | 6/1990 | Watanabe et al. | 570/130 |
| 4,950,814 | 8/1990 | Maeds et al. | 570/130 |

FOREIGN PATENT DOCUMENTS

| | | |
|---|---|---|
| 0222149 | 5/1987 | European Pat. Off. . |
| 0366123 | 5/1990 | European Pat. Off. . |

OTHER PUBLICATIONS

Y. B. Kutsenok et al, Chemical Abstracts, vol. 88, No. 44, Jan. 23, 1978, p. 111, "Fluorinated carbon".

*Primary Examiner*—J. E. Evans
*Attorney, Agent, or Firm*—Oblon, Spivak, McClelland, Maier & Neustadt

[57] ABSTRACT

The present invention relates to a method for preparing a pitch fluoride, which comprises reacting pitch with fluorine in a fluorine type inert medium.

14 Claims, No Drawings

METHOD FOR PREPARING PITCH FLUORIDE

The present invention relates to a method for preparing a pitch fluoride.

Recently, it was known that a pitch fluoride could be formed by reacting pitch with a fluorine gas at a temperature of from 0° to 350° C. (Japanese Unexamined Patent Publication No. 275190/1987).

The pitch fluoride is a compound having the compositional formula $CF_x(0.5<x<1.8)$ wherein from 1 to 3 fluoride atoms are firmly bonded with each carbon atom by covalent bonding. This compound has a color varying depending on the fluorinating conditions and the kinds of pitch, for example, brown-yellow white-white, and is excellent in stability in air and also excellent in water resistance, chemical resistance and the like. The chemical structure of the pitch fluoride is similar to that of a graphite fluoride, but its fluorine content can be made larger than that of the graphite fluoride and the reaction temperature in the preparation of the pitch fluoride can be made lower than that in the preparation of the graphite fluoride.

As well known, pitch which is a starting material for a pitch fluoride comprises a mixture of various kinds of aromatic hydrocarbon derivatives, and is highly reactive with a fluorine gas. When a powdery pitch placed in a reactor is reacted with fluorine gas, it is difficult to satisfactorily control the reaction heat generated locally and it is therefore difficult to uniformly fluorinate pitch.

Furthermore, when the powdery pitch is brought into contact with the fluorine gas under stirring in order to conduct uniform fluorination, there is a fear of causing dust explosion which arouses significant problem for safe production.

The present invention is to remove the above mentioned problems and to provide a method for preparing a solid-like or liquid like pitch fluoride, which comprises reacting pitch with fluorine in a fluorine type inert medium.

The phase of a pitch fluoride obtained by reacting fluorine with pitch varies depending on the type of the starting pitch, reaction temperature and other conditions. For example, one is a liquid pitch fluoride that is a liquid at a temperature in the range of from −10° C. to 50° C. and the other is a solid pitch fluoride that is a solid in the above mentioned temperature range.

The fluorine type inert medium is a chemically and thermally stable compound inert to pitch, fluorine and pitch fluoride, preferable examples of which include a perfluoro compound and a cheap KF.nHF melt.

Examples of the perfluoro compound include perfluorotrialkylamine, perfluorocyclic ether, perfluoropolyether, perfluoroalkane and a mixture thereof. Preferable examples of the perfluoro compound include perfluorotributylamine, perfluorotriamylamine, perfluoro(2-butyltetrahydrofuran), perfluoro(2-propyltetrahydropyran), perfluoropolyether (for example $CF_3(OCF(CF_3)CF_2)_p(OCF_2)_q)OCF_3$; p, q=0–10) and the like.

In addition to the above mentioned perfluoro compounds, when the reaction temperature is low, there can be used a perfluoro compound, a part of fluorine of which is substituted with chlorine, such as polyfluoropolychloroalkanes.

In the case of the KF.nHF melt, its melting point largely varies depending on the content of HF, and in the present invention, "n" in the chemical formula is from 0.5 to 2.5, preferably from 1 to 2.

In this melt, there may be present alkali metal fluorides such as LiF and NaF, alkali earth metal fluorides such as $CaF_2$, and other metal fluorides such as $AlF_3$ and $SbF_5$.

When the reaction temperature of pitch and fluorine is high, it is preferable to use an oily perfluoro compound, a KF.nHF melt and the like.

When pitch is reacted with fluorine in the present invention, it is preferable to charge and disperse the starting pitch in the above mentioned inert medium under vigorous stirring at a temperature of from 0° to 350° C. and then to introduce a fluorine gas therein by bubbling. The fluorine gas may be introduced as it is, but it may be introduced after diluting with an inert gas such as $N_2$ gas and Ar gas. The reactor may be made of a material such as SUS, monel metal and nickel, but it is preferable to use a nickel-made reactor when the reaction temperature exceeds 150° C.

Examples of "pitch" used as a starting material in the present invention, include distillate products obtained by subjecting petroleum type or coal type heavy oils to distillation operation to remove a low boiling component having a boiling point of lower than 200° C. and the product further subjected to heat treatment and/or hydrogenation treatment, such as petroleum distillate residues, naphtha pyrolysis residues, ethylene bottom oils, liquefied coal oils and coal tars. Typical examples include an isotropic pitch, a meso-phase pitch, a hydrogenated meso-phase pitch and the like, and further include meso-carbon microbeads obtained by extracting meso-phase spheres formed by subjecting petroleum type or coal type heavy oils to distillation operation to remove a low boiling component and further subjecting the distillation product to heat treatment.

The solid pitch fluoride may melt or may not melt, and the solid pitch fluoride having a melting temperature of from 50° C. to about 250° C. becomes transparent resin-like in the melted state or the re-cooled solid state. The solid pitch fluoride is obtained preferably by charging the starting pitch into the above mentioned fluorinated inert medium in an amount of from 0.1 to 50 wt. %, preferably from 1 to 25 wt. % on the basis of the weight of the medium, vigorously stirring and dispersing them at a predetermined reaction temperature of from 0 to 350° C., preferably from 50° to 200° C., more preferably from 50° to 150° C. and introducing a fluorine gas therein by bubbling while maintaining the above reaction temperature.

The reaction to obtain the solid pitch fluoride in accordance with the present invention may be carried out under normal pressure or pressurized condition, but it is preferable from the point of operation to carry out the reaction under normal pressure using the above mentioned inert medium having a boiling point of from 100° C. to 300° C.

The amount of the fluorine gas required for the reaction depends on the desired degree of fluorination of the solid pitch fluoride produced, and is not limited, but the amount of the fluorine gas required to fluorinate 1 g of pitch is generally from 1.0 l (about 45 mmol) to 4.0 l (about 180 mmol).

After the reaction, the solid pitch fluoride produced can be easily separated by filtering from the dispersion medium or distilling off the dispersion medium and drying the solid thus obtained.

One of the methods to obtain a liquid pitch fluoride comprises charging a previously prepared solid pitch fluoride into the above mentioned fluorine type inert medium in an amount of from 0.1 to 90 wt. %, preferably from 1 to 30 wt. % on the basis of the weight of the medium, vigorously stirring and dispersing them at a temperature of from 130° C. to 550° C. and introducing a fluorine gas by bubbling.

Another method comprises preparing a solid pitch fluoride by reacting fluorine with pitch in a fluorine type inert medium and further reacting fluorine with the solid pitch fluoride thus obtained in the fluorine type inert medium to obtain a liquid pitch fluoride. The temperature of the first reaction of pitch and fluorine to obtain the solid pitch fluoride is from 0° to 350° C., preferably from 50° to 200° C., more preferably from 50° to 150° C. The temperature of the second reaction of the solid pitch fluoride and fluorine is from 130° to 550° C., and is preferably from 30° to 200° C., more preferably from 50° to 150° C. higher than that of the first reaction.

The solid pitch fluoride produced in the fluorine type inert medium can be easily separated, but is preferably subjected to the succeeding fluorination with a fluorine gas without separating.

The pitch used for the first fluorination and the solid pitch fluoride are preferably dispersed or dissolved in a fluorine type inert medium. A perfluoro compound such as perfluorotributylamine is a preferable medium to dissolve the solid pitch fluoride.

The fluorine gas may be introduced as it is, but it may be introduced as a mixture with other inert gases such as $N_2$ gas and Ar gas.

The reaction of the solid pitch fluoride with fluorine gas in accordance with the present invention may be carried out under normal pressure or pressurized condition, but it is preferable from the point of operation to carry out the reaction under normal pressure using the above mentioned fluorine type inert liquid medium having a boiling point of from about 100° C. to 300° C.

Examples of the fluorine type inert medium include the above mentioned perfluoro compound, KF.nHF melt, and the like, but the liquid pitch fluoride per se obtained in the present invention may be used as the fluorine type inert medium. The KF.nHF melt and an oily perfluoro compound are suitable for the case of the reaction of the solid pitch fluoride and fluorine gas, the reaction temperature of which is relatively high.

The amount of the fluorine gas required for the reaction depends on the desired degree of fluorination of the product, and is not limited. For example, the amount of the fluorine gas required for fluorinating 1 g of pitch to obtain a solid pitch fluoride is generally from 1.0 l (about 45 mmol) to 4.0 l (about 180 mmol), and after raising the temperature of the reaction system, the amount of the fluorine gas further required to obtain a liquid pitch fluoride is generally from 0.1 l (about 4.5 mmol) to 1.0 l (about 45 mmol).

The amount of the fluorine gas required for reacting with the previously prepared solid pitch fluoride is not also limited, but the fluorine gas is introduced generally in an amount of from 0.1 l (about 4.5 mmol) to 1.0 l (about 45 mmol) to 2.5 g of the solid pitch fluoride at a predetermined reaction temperature.

After the reaction, the liquid pitch fluoride produced can be easily separated from the dispersion medium by distillation or by using a separatory funnel.

As is well known, the starting pitch used in the present invention comprises a complex mixture of various kinds of aromatic hydrocarbon derivatives, and a solid-like pitch fluoride obtained by fluorinating pitch has a basic structure wherein all fluorine atoms are bonded at trans-positions with respect to cyclohexane rings of carbon planes, and this structure is considered to be bonded by means of a cross linking bonding of —$CF_2$— and the like or this structure is considered to have a layered structure bonded by means of Van der Waals force. The solid-like pitch fluoride is further fluorinated by cutting a bond and fluorinating at the part where a bond between atoms is relatively weak. As this result, there can be obtained a liquid-like pitch fluoride having several cyclohexane rings of the carbon plane as the main basic structure.

The liquid-like pitch fluoride thus obtained has excellent heat resistance and chemical resistance, and is a useful compound in various fields as a cleaning agent or a probing agent for electronic parts, a vapor phase medium for soldering and an oil for high vacuum.

EXAMPLES

Now, the present invention will be described in further detail with reference to Examples. However, it should be understood that the present invention is by no means restricted to such specific Examples.

EXAMPLE 1

A hydrogenated anthracene oil was added in an equivalent amount to coal tar, and the resultant mixture was subjected to heat treatment at 450° C. to prepare a hydrogenated mesophase pitch having a softening point of 307° C. The result of the elemental analysis of the hydrogenated mesophase pitch thus obtained was as follows:

C: 95.39%, H: 3.79%, N: 0.66%, O: 0.79%

3 g of the hydrogenated mesophase pitch thus obtained and 140 ml of perfluoropolyether having the formula $CF_3(OCF(CF_3)CF_2)_3OCF_2OCF_3$ were charged in a cylindrical stainless steel reactor having a content of 400 ml and an inner diameter of 55 mm. The reactor was equipped with a stainless steel reflux-cooling tube, a gas-introducing tube, an agitating blade and a thermometer, and an off-gas used for bubbling in the system was discharged to the outside by way of a cooling tube, an NaF-packing tube and a washer containing KOH aqueous solution. A dry $N_2$ gas was fully introduced into the system to replace air by $N_2$, and 5.7 l (about 254 mmol) of $F_2$ gas diluted to 10% concentration with $N_2$ gas was introduced under vigorous stirring at 100° C. for 14 hours.

After the reaction, the reaction product was filtered out at room temperature, and was subjected to vacuum drying to obtain 3.15 g of a yellow white solid. Further, the filtrate was distilled off under reduced pressure, and the remaining material was subjected to vacuum drying to obtain 3.42 g of a yellow white solid. The results of $^{19}$Fnmr, IR and X-ray diffraction analysis and elemental analysis show that these solids thus obtained were a solid-like pitch fluoride expressed by the compositional formula $CF_{1.25}$.

EXAMPLE 2

The same procedure as in Example 1 was repeated, except that fluorination reaction was carried out at a temperature of 70° C. using the hydrogenated mesophase pitch obtained in Example 1 and an equivalent amount mixture solution of perfluoro(2-propyltetrahydropyran) and perfluoro(2-butyltetrahydrofuran) as a dispersion medium for pitch, to obtain 8.04 g of a yellow white solid-like pitch fluorde [3.51 g of the filtered dry product ($CF_{1.06}$) and 4.53 g of a dry product from the filtrate ($CF_{1.06}$)].

EXAMPLE 3

The same procedure as in Example 1 was repeated using the hydrogenated mesophase pitch obtained in Example 1, except that fluorination reaction was carried out using perfluorotributylamine as a dispersion medium for pitch. After the reaction, the pitch fluoride thus produced was completely dissolved in a solvent, and became transparent. After distilling off the solvent under reduced pressure, the remaining solid was subjected to vacuum drying, thus obtaining 8.73 g of a solid-like pitch fluoride expressed by the compositional formula $CF_{1.16}$.

EXAMPLE 4

12 g of the hydrogenated meso-phase pitch obtained in Example 1 and 140 ml of perfluoropolyether having a boiling point of about 270° C. were charged in a cylindrical stainless steel reactor having a content of 400 ml and an inner diameter of 55 mm. The reactor was equipped with a stainless steel reflux-cooling tube, a gas-introducing tube, an agitating blade, a thermometer and a baffle plate, and an off-gas bubbled into the system was discharged to the outside by way of a cooling tube, an NaF-packing tube and a washer containing a KOH aqueous solution. A dry $N_2$ gas is fully introduced into the system to replace air with $N_2$, and 21.9 l (about 976 mmol) of $F_2$ gas diluted to 15% concentration with $N_2$ gas was introduced under vigorous stirring at 100° C. for 77 hours. As this result, a mixture having a light yellow solid-like pitch fluoride suspended in perfluoropolyether was obtained.

Thereafter, the suspension thus obtained was heated to 230° C., and 4.5 l (about 200 mmol) of $F_2$ gas diluted in the above mentioned manner was further introduced at 230° C. for 11 hours.

After the reaction, 8.3 g of a liquid-like pitch fluoride that is a liquid at room temperature was recovered from a cooling trap. The results of gas chromatography, mass spectrometry, IR and $^{19}$Fnmr analysis showed that the liquid product thus obtained was a mixture of several kinds of liquid-like pitch fluorides having a boiling point of from 30° C. to 130° C. and having cyclohexane rings in the basic structure as the main component.

The content of the reactor was a colorless transparent liquid, and 16.4 g of a liquid-like pitch fluoride was distilled out at a distillation temperature of from 70° C. to 250° C. and 3.7 g of a liquid-like pitch fluoride was distilled out together with 140 ml of the perfluoropolyether solvent at a distillation temperature of from 250° C. to 280° C.

After completely distilling off the liquid component, 4.2 g of a transparent resin-like pitch fluoride having a melting point of about 110° C. was recovered as the still residue.

The product recovered as the distillate was a mixture of liquid-like pitch fluorides having a cyclohexane ring in the basic structure as the main component.

REFERENCE EXAMPLE 1

15 g of the hydrogenated meso-phase pitch of Example 1 was placed in a stainless steel reactor, and 26.9 l (about 1.2 mol) of $F_2$ gas diluted to 20% concentration with $N_2$ gas was introduced therein at 100° C. for 70 hours to obtain 44 g of a powdery white yellow pitch fluoride. Elemental analysis showed that the solid-like pitch fluoride thus obtained had an atomic ratio of F/C=1.3.

EXAMPLE 5

30 g of the powdery pitch fluoride obtained in Reference Example 1 and 140 ml of perfluoropolyether having a boiling point of about 270° C. were charged in the same reactor as mentioned in Example 1. A dry $N_2$ gas was fully introduced into the system to replace air with $N_2$, and 4.5 l (about 200 mmol) of $F_2$ gas diluted to 15% concentration with $N_2$ gas was then introduced at 230° C. for 11 hours under vigorous stirring. After the reaction, 7.8 g of a mixture of liquid-like pitch fluorides having a boiling point of about 30° C. to 130° C. was obtained from a cooling trap.

The content of the reactor was a colorless transparent liquid, and this was subjected to distillation. As this result, 17.0 g of a liquid-like pitch fluoride was distilled out at a distillation temperature of from 70° C. to 250° C., and about 4.1 g of a liquid-like pitch fluoride was recovered together with 140 ml of the perfluoropolyether solvent at a distillation temperature of from 250° to 280° C.

After completely distilling off the liquid component, 3.4 g of a transparent resin-like pitch fluoride having a melting point of about 110° C. was recovered as the still residue.

The liquid-like pitch fluoride thus obtained was a mixture of a liquid-like pitch fluoride having a cyclohexane ring in the basic structure as the main component.

EXAMPLE 6

30 g of the powdery pitch fluoride obtained in Reference Example 1 and 300 g of KF.1.2HF were charged in the same reactor as mentioned in Example 1.

A dry $N_2$ gas was fully introduced in the system to replace air with $N_2$, and 5.0 l (about 223 mmol) of $F_2$ gas diluted to 15% concentration with $N_2$ gas was then introduced in the melted state of KF.1.2HF at 230° C. for 12 hours under vigorous stirring. The cooling tube fixed to the reactor was replaced by a Liebig type cooling tube, and the temperature was raised to 290° C. while bubbling $N_2$ gas in the system to distill a liquid-like pitch fluoride out from the system and to recover 28.3 g of a liquid-like pitch fluoride in total.

The compound thus obtained was a mixture of a liquid-like pitch fluoride having a cyclohexane ring in the basic structure as the main component.

As mentioned above, the method of the present invention has the following advantages, and can provide a solid-like or liquid-like pitch fluoride economically.

(a) A pitch or pitch fluoride can be uniformly and efficiently dispersed and stirred.
(b) The reaction temperature can be easily controlled.
(c) The reaction can proceed at a uniform temperature.
(d) A product of stable quality can be obtained.
(e) There is no fear of dust explosion.

What is claimed is:

1. A method for preparing a pitch fluoride which consists essentially of reacting pitch with fluorine at a temperature of from 0° to 350° C. in a fluorine type inert medium, which fluorine inert medium is liquid during reaction, by dispersing pitch in the fluorine type inert medium and then introducing fluorine therein.

2. The method according to claim 1, wherein the fluorine type inert medium is a KF.nHF melt.

3. The method according to claim 1, wherein the fluorine type inert medium is a perfluoro compound.

4. The method according to claim 3, wherein the perfluoro compound is at least one member selected from the group consisting of perfluorotrialkylamine, perfluorocyclic ether and perfluoropolyether.

5. A method for preparing a liquid-like pitch fluoride, which consists essentially of reacting a solid-like pitch fluoride with fluorine at a temperature of from 130° to 550° C. in a fluorine type inert medium, which medium is liquid during reaction, by dispersing or dissolving the solid-like pitch fluoride in the fluorine type inert medium and then introducing fluorine therein.

6. The method according to claim 5, wherein the fluorine type inert medium is a KF.nHF melt.

7. The method according to claim 5, wherein the fluorine type inert medium is a perfluoro compound.

8. The method according to claim 5, wherein the perfluoro compound is at least one member selected from the group consisting of perfluorotrialkylamine, perfluorocyclic ether and perfluoropolyether.

9. A method for preparing a liquid-like pitch fluoride, which consists essentially of preparing a solid-like pitch fluoride by reaction of pitch with fluorine at a temperature of from 0° to 350° C. in a fluorine type inert medium and then reacting the resultant solid-like pitch fluoride with fluorine in a fluorine type inert medium, wherein said fluorine type inert medium is liquid during reaction, by dispersing the pitch or solid-like pitch fluoride in the inert medium and then introducing fluorine therein.

10. The method according to claim 9, wherein the temperature of the reaction of the solid-like pitch fluoride with fluorine is higher than the temperature of the reaction of the pitch with fluorine, and is from 130° to 550° C.

11. The method according to claim 10, wherein the temperature of the reaction of the solid-like pitch fluoride with fluorine is from 30° to 200° C. higher than the temperature of reaction of the pitch with fluorine.

12. The method according to claim 9, wherein the fluorine type inert medium is a KF.nHF melt.

13. The method according to claim 9, wherein the fluorine type inert medium is a perfluoro compound.

14. The method according to claim 9, wherein the perfluoro compound is at least one member selected from the group consisting of perfluorotrialkylamine, perfluorocyclic ether and perfluoropolyether.

* * * * *